United States Patent [19]

Hartmeister

[11] Patent Number: 4,729,170

[45] Date of Patent: Mar. 8, 1988

[54] HAND TOOL WITH PERPENDICULAR ACTING DIES ON PIVOTED HANDLE SET

[76] Inventor: Ruben J. Hartmeister, 1034 6th St., Golden, Colo. 80401

[21] Appl. No.: 936,447

[22] Filed: Dec. 1, 1986

[51] Int. Cl.[4] ..... B26F 1/00

[52] U.S. Cl. ..... 30/363; 30/229; 72/409

[58] Field of Search ..... 30/363, 364, 366, 358, 30/178, 229; 72/409; 81/355

[56] References Cited

U.S. PATENT DOCUMENTS

| | | | |
|---|---|---|---|
| D. 282,624 | 2/1986 | Hartmeister | D8/52 |
| 311,121 | 0/1885 | Hair | 72/409 |
| 2,252,575 | 8/1941 | Longfellow | 30/363 X |
| 3,842,650 | 10/1974 | Hartmeister | 72/409 |

FOREIGN PATENT DOCUMENTS

| | | | |
|---|---|---|---|
| 335458 | 1/1904 | France | 30/363 |

*Primary Examiner*—Douglas D. Watts
*Attorney, Agent, or Firm*—Kyle W. Rost

[57] ABSTRACT

A punch tool provides two generally longitudinal handles joined by a transverse pivot pin that is carried in a resilient bushing. One of the handles defines a straight bore that houses a sliding punch die and further defines a support for a mating, stationary die. The second handle is joined to the sliding die such that relative movement between the handles causes the sliding die to move within the bore, toward or away from the stationary die. Flexibility of the bushing permits the pivot pin to shift its axis longitudinally of the tool while permitting straight movement of the sliding die.

9 Claims, 12 Drawing Figures

HAND TOOL WITH PERPENDICULAR ACTING DIES ON PIVOTED HANDLE SET

BACKGROUND OF THE INVENTION

1. Field of the Invention

The invention generally relates to cutting and more specifically relates to a hand tool for punching holes in sheet goods. The invention also generally relates to cutlery and to the construction of a pivoted handle for operating various types of punching and cutting dies.

2. Description of the Prior Art

Hand tools for cutting or punching sheet goods are known to exist in a variety of configurations. A popular arrangement employs a scissors-style crossing levers joined at a central pivot, with the punch dies of the head being carried on the levers at the opposite side of the pivot from the handle. Such a relatively simple arrangement is found in U.S. Pat. No. 311,121 and in many other punches. The scissors lever arrangement is simple and inexpensive but lacks precision because the dies are moving together on arcs. However, such punches are used in many situations where their light weight and simple operation are adequate.

Other hand punches or similar tools have employed parallel moving jaws or dies. U.S. Design Pat. No. 282,624 discloses a parallel jaw punch. The punch dies would be expected to be more accurate because of the head has parallel movement, although the operating levers and die supports are more complex in order to enable the parallel motion.

Still another variety of punch employs cams in the punch head to multiply the power of the jaws. U.S. Pat. No. 3,842,650 discloses such a punch, wherein the die stroke is short but very powerful. This type of punch is heavy duty and may be considerabley more expensive than the previously described types. In addition, its use may be limited by its heavy construction and limited jaw opening.

It would be desirable to have a perpendicular operating die in a hand tool that uses a simplified pivoted handle. For many uses, such as punching cord holes in window blinds, a light weight but accurate punch is desired. In addition, it would be desirable to have a hand operated, light weight punch that is capable of forming multiple holes and complex shapes, which would require replaceable dies and good accuracy in the punch head.

To achieve the foregoing and other objects and in accordance with the purpose of the present invention, as embodied and broadly described herein, the punch of this invention may comprise the following.

SUMMARY OF THE INVENTION

Against the described background, it is therefore a general object of the invention to provide an improved hand operated tool with perpendicular acting dies in the head and a simplified pivot action in the handle levers.

A more specific object is to provide a resilient pivot structure that can absorb the arcuate, longitudinal offset motion that results when pivot action handles are used to actuate a perpendicular action head.

Another object is to provide a pivoted handle lever arrangement that will produce down motion of the upper die on the power stroke.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a hand operated tool is constructed from a first die housing opposed by a mating die plate support member, a neck joining the first die housing and die plate support member in mutually separated position and defining a workpiece-receiving cavity therebetween, a first die carried by the punch housing for motion toward and away from the die plate support member, and a first handle lever pivotally attached to the die housing and connected to the first die for moving the first die with respect to the die housing in response to relative pivotal motion between the handle lever and die housing.

According to another aspect of the invention, a hand operated tool with a generally longitudinally extending, pivoted handle set and perpendicular acting dies includes a male die housing defining therein a cavity for reception of a male die and a transverse die pin bore across the cavity, and further defining a transverse pivot pin bore offset longitudinally forwardly of the die pin bore. A die plate support member is spaced from the die housing, and a neck connects the die housing to the die plate support member and maintains and defines a workpiece receiving space therebetween. A first longitudinally extending handle lever has side walls depending over opposite transverse sides of the die housing and defines spaced apart apertures in alignment with the pivot pin bore and die pin bore. A pivot pin is received in the pivot pin bore and in the aligned apertures of the first handle lever. The diameter of the pivot pin is substantially smaller than the diameter of the pivot pin bore and leaves a substantial clearance between the pin and the bore wall. A resilient means is received in the pivot pin bore and occupies the clearance while permitting deflection of the pivot pin toward and away from the bore wall. A male die has its stem supported in the die cavity for axial sliding motion toward the die plate support member and has a die pin engaged in the stem and extending through the die pin bore and the aligned apertures of the first handle lever. As a result, the pivotal motion of the handle lever on the pivot pin causes axial displacement of the male die with radial displacement of the pivot pin against the resilient means within the pin bore.

The accompanying drawings, which are incorporated in and form a part of the specification illustrate preferred embodiments of the present invention, and together with the description, serve to explain the principles of the invention. In the drawings:

DESCRIPTION OF THE PREFERRED EMBODIMENTS

According to the embodiment of the invention shown in FIGS. 1–5, a hand operated tool 20 is provided that has perpendicular acting dies carried on a handle set having pivoted operation and a novel, simplified construction. The general construction of the tool is adaptable to be used with jaws or dies for accomplishing many types of tasks, including crimping, grommet forming, metal forming, and punching. The preferred embodiment will be described as being a punch, although it should be understood that by variation in the jaws and/or dies, other functions are accomplished with equal benefit.

The punch 20 of FIGS. 1–5 is adaptable to operate with a variety of materials and tasks, although it has been designed specifically to punch and notch various types of window blinds and their related assemblies. Thus, the punch operates on thin metals, plastic fabric, and other materials that might be used in the construction of vertical and horizontal window blinds. In order to accurately punch this variety of materials, the punch dies are carried for perpendicular motion, wherein one of the dies is moved on an axis normal to the other; and in order to maintain a simple mechanism, the punch handle levers are connected for substantially pivoted motion. The pivotal connection between the two handle levers accommodates a necessary arcuate offset motion by absorbing the offset in a flexible, resilient bushing at the pivot point.

Figure 1:
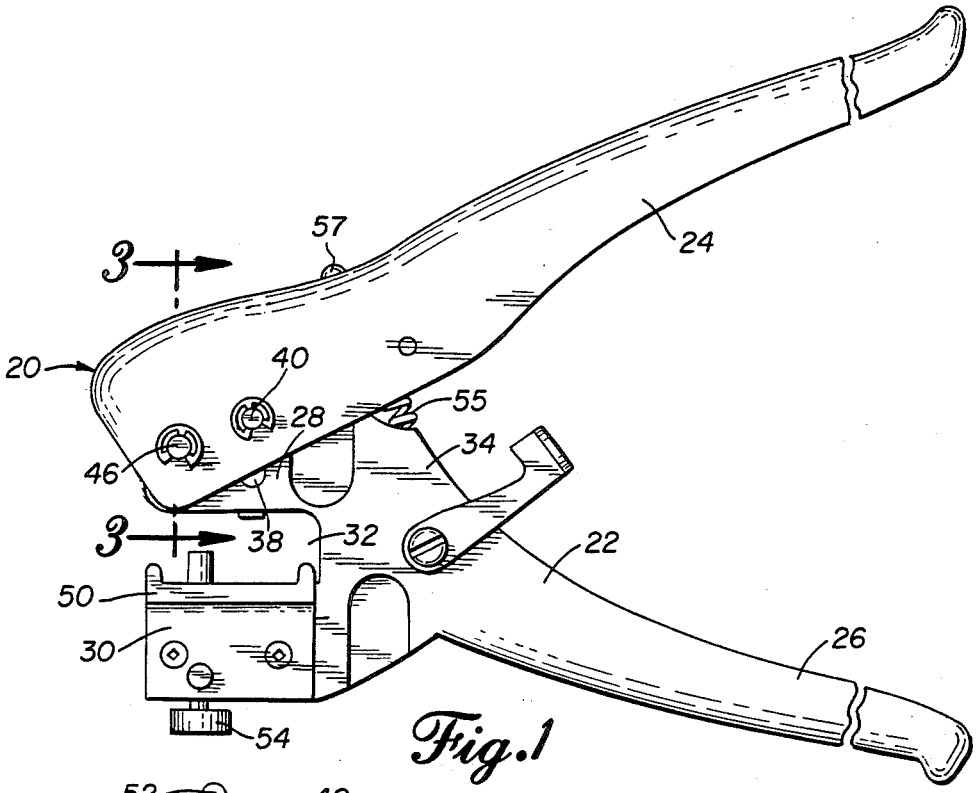
FIG. 1 is a left side view of the tool.
Figure 2:
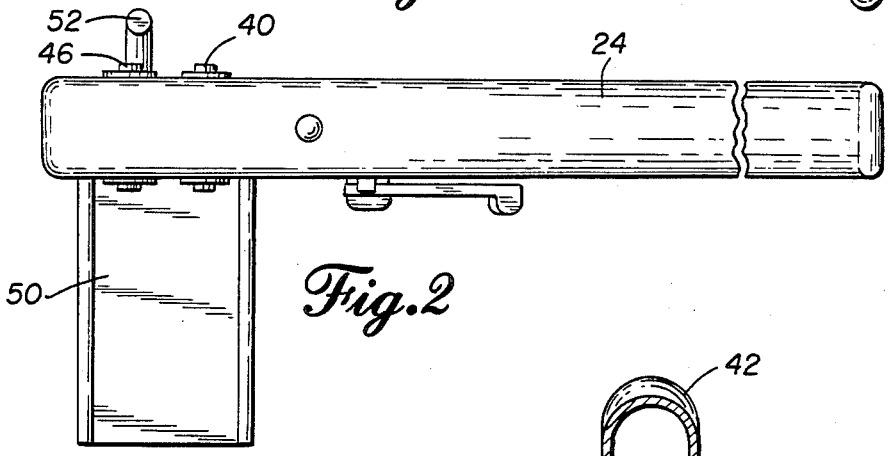
FIG. 2 is a top view thereof.

Punch 20 includes a handle lever set that generally follows the longitudinal axis of the punch, which axis extends from right to left as the tool is shown in FIGS. 1 and 2. The first or lower handle lever 22 carries both of the punch dies, while the second or upper lever 24 activates one of the dies for motion with respect to the other die and the first lever. Specifically, the lower handle includes a hand grip lever portion 26, a die housing portion 28 that receives an upper, male die, and a die plate support portion 30 that carries a lower, female die plate. A workpiece receiving area of jaw opening cavity 32 is defined between the two die housing areas and may take the form of a recess from the longitudinal front end of the punch, which is to the left in FIGS. 1 and 2. At the rear end of the recess, the die housing portions 28 and 30 are joined by a neck 34 that supports the die housing areas in mutually spaced relationship and thereby defines the workpiece receiving cavity.

Figure 3:
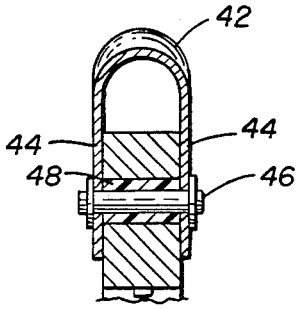
FIG. 3 is a vertical cross-sectional view taken along the plane of line 3—3 of FIG. 1.
Figure 4:
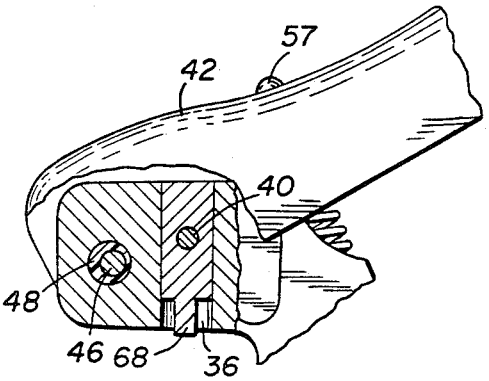
FIG. 4 is a left side fragmentary view of the tool head, with the handle partially broken away to show the pivot pins and bushing, with the tool head in open position.
Figure 5:
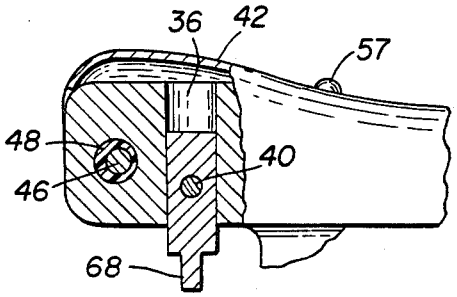
FIG. 5 is a view similar to FIG. 4, showing the tool head in closed position.

As is best shown in FIGS. 3–5, the die housing 28 defines a cylindrical bore 36 that has its axis is perpendicular to the die plate support area. The lateral sides of the bore define vertically elongated slots 38 that extend through the lateral sides of the housing 28 and permit a transverse die pin 40 to be passed through an aligned opening in the stem of a male die contained in the bore 36 to join the die to the upper handle. With this connection, the die is forced to move in the housing in response to movement of the upper handle, as generally illustrated by the two positions of the male die shown in FIGS. 4 and 5. As shown in FIG. 4, when the upper handle is in raised or open position, the male die is raised. When the upper handle is in down stroke or closed position, the male die is extended downwardly from the bore and performs the punching operation.

The upper handle includes a head portion 42 at its longitudinally forward end, which head portion is defined by a pair of spaced apart side walls 44. The width between the side walls 44 is sufficient to allow the side walls to partially overlap the sides of the die housing 28. These side walls 44 are apertured to receive the die pin 40, which may be secured in place against lateral movement by C-ring fasteners or the like, as shown in the drawings. The head 42 also is apertured through the side walls 44 at a position forward of the die pin 40 to receive a pivot pin 46 by a similar fastening arrangement.

Pivot pin 46 is on a parallel axis to die pin 40 and is longitudinally relatively closer to the front of the tool 20, with the result that the die pin causes the male die to extend on the down stroke of the upper handle. The die housing 28 includes a corresponding hole that receives the pivot pin and, further, has a substantial radial clearance in addition to the radial dimension of the pin. For example, the pin 46 may have a 3/16 inch diameter, and the hole through the handle side walls may be closely similar to this dimension in order to hold the pin. However, the bore through the die housing 28 may have a 5/16 inch diameter, creating a $\frac{1}{8}$ inch maximum clearance between the pin and the bore wall. This clearance is occupied by a cylindrical bushing 48 formed from rubber or like resilient, flexible material. Thus, the pivot pin is suspended with respect to the die housing in the resilient material of the bushing 48.

The lower die is carried on the die plate support 30. This die, which may be a female die plate, may be mounted on a workpiece guide table 50, that, in turn, is directly mounted on the support member 30, such as by bolts. The lower die housing and guide table also may carry a length gage 52 mounted transversely on the tool, for example through a transverse bore located below the top surface of the guide 50. A clamping screw 54 entering the gage bore throught the bottom of the support 30 may permit the gage to be shifted laterally to any desired position within the length of the gage. The gage and workpiece guide are particularly useful for trimming and notching window blinds, as each slat of the blinds may be trimmed by a uniform amount when homed against the gage, and the slats will be punched at a uniform position of width when each slat is homed against the edge of the guide 50.

The punch 20 is assembled, first, by placing a compression spring 55 between the upper and lower handles. For example, the spring may be received in a vertical bore in the neck 34 of the lower handle and telescope over a guide pin or rivet 57 in the head of the upper handle 24. Next, the male die is placed in bore 36, and the die housing portion 28 of the lower handle 22 is placed between the side walls of the upper handle. Then, the pivot pin 46 and die pin 40 are pushed into their respective bores. When the punch handles are squeezed together, the spring 55 is compressed and the handles pivot with respect to each other on the pivot pin 46. During such pivotal motion, pin 40 is moved vertically in slot 38 perpendicular to female die 62, in turn forcing movement of the male die contained in bore 36 of the die housing 28. The use of a close fit between the die pin and die pin bore has an added benefit in that the die pin prevents rotation of the male die in bore 36. Thus, the punch operates with accuracy of alignment with die plate 62 as the male die approaches the female die along a normal axis and without twisting motion.

Punch 20 may accomplish various and different tasks, depending upon the particular dies and workpiece guide tables that are installed. The distance between the pivot pin and die pin may approximate one inch, with the result that the leverage advantage to the dies of a normally sized hand tool may be approximately 10:1, which allows the tool to punch through many types of sheet materials, including both metal and plastic. In FIGS. 1 and 2, the workpiece guide 50 is provided with front and rear lips and is intended to receive a laterally inserted blind slat having the same dimension as the distance between the lips. The slat would be homed against the gage 52 and punched, for example to receive a draw cord.

Figure 6:
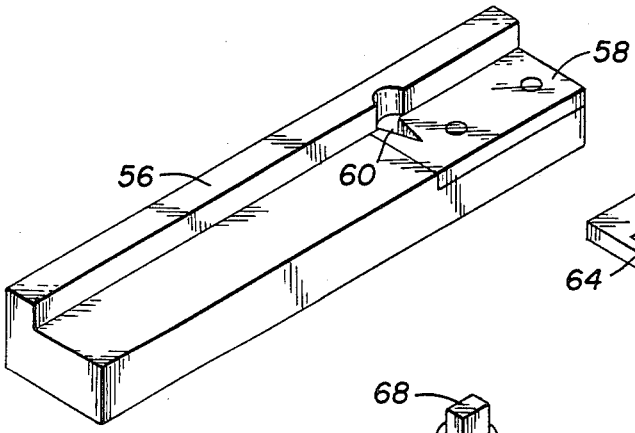
FIG. 6 is an isometric view of the die plate and support table.

In FIG. 6, a modified guide 56 is shown, wherein only a rear lip is present and the front edge of the guide table is open. This guide table carries the female die plate 58 having a V-shaped die slot 60 adjacent to and extending into the rear lip. The female die plate is removeable from the guide table and may be substituted for others, as described below. Guide table 56 and die 58 are intended for use in notching the edge of a blind slat, for example to permit the blind slat to be bent at the notch when the blind slat is being converted to use as a valance. In order to be accurately notched, the blind slat would be inserted into the workpiece area 32 from the front of the tool and homed against the rear lip of the guide table. Also, the blind slat may be homed laterally against the gage rod. The punch would notch the blind at an edge, at a predetermined distance from one end of the slat, as determined by the position of the gage rod. Then, the blind could be turned over and reinserted into the punch with the same end against the gage rod, resulting in a notch being placed exactly opposite the first notch. Such a blind could be bent on the line connecting the two notches, thereby forming the corner bend of a valance.

Figure 7:
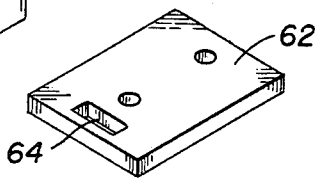
FIG. 7 is an isometric view of another embodiment of the die plate.
Figure 8:
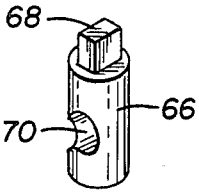
FIG. 8 is an isometric view of a punch head, showing a first embodiment of the punch head die.

Another female die plate 62 is shown in FIG. 7, having a rectangular die opening 64 that is used in combination with the male die of FIG. 8. Typical of male dies used with the punch 20, the male die has a stem 66 of cylindrical configuration, sized to fit within the cylindrical bore 36 of die housing 28. The head 68 of the die is rectangular and sized to fit the opening 64 of die plate 62. A diametric hole 70 is formed in the stem 66 and is sized to receive the die pin 40. The die pair 64, 68 corresponds to the typical dies that would be used with the workpiece guide table 50 of FIGS. 1 and 2.

Figure 9:
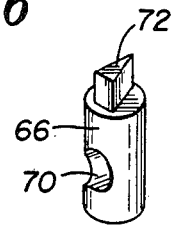
FIG. 9 is an isometric view of a punch head, showing a second embodiment of the punch head die.
Figure 10:
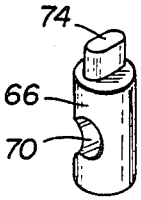
FIG. 10 is an isometric view of a punch head, showing a third embodiment of the punch head die.
Figure 11:
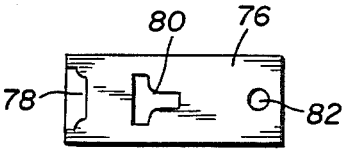
FIG. 11 is an isometric view of a punch head, showing multiple head dies.

The male die of FIG. 9 is similar in structure, with the substitution of the V-shaped head 72 that matches the opening 60 of die plate 58. FIG. 10 shows an oval die head 74 that would be used with a similarly shaped female die. Finally, a multiple male die 76 is shown in FIG. 11, having a triple head including, for example, a notch head 78, a T-section head 80, and a punch head 82. All three heads are carried on a single stem, and the corresponding female die plate would have appropriately matching die holes. Thus, the uses of the punch 20 are variable according to the nature of the dies and guide tables, both of which can be changed as desired. The perpendicular action between the male and female dies permits even complex die shapes and multiple die heads to be used, despite the simple closing action of the handles.

The operation of the punch permits the male die to be moved toward and away from the female die along a perpendicular line, which is the centerline of the cylindrical bore 36. Since the punch handles 22 and 24 operate on a single pivot pin 46, the distance between pivot pin 46 and die pin 40 constitutes a radius and, ordinarily, would require that pin 40 swing through an arc instead of moving along a straight line. However, the use of bushing 48 around pivot pin 46 enables the die pin to move along the required straight line for proper interaction of the die pairs.

Figure 12:
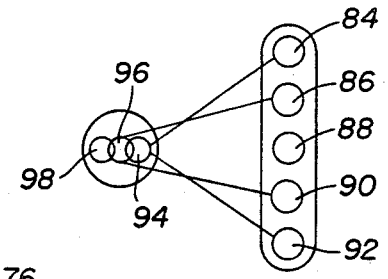
FIG. 12 is a schematic representation of the relative positions of the pivot pin and die pin over the full range of die pin movement.

FIG. 12 illustrates the movement of the die pin and the corresponding movement of the pivot pin. With respect to the orientation of the tool 20 in FIG. 1, as the die pin 40 moves vertically on the down stroke from the highest position 84 to successively lower positions 86, 88, 90, and 92, the pivot pin moves longitudinally in its floating bushing. When the die pin is in its extreme vertical positions 84 and 92, the pivot pin is pulled longitudinally toward the die pin and is in its closest position 94 to bore 36. When the die pin is intermediate its vertical extremes 84 and 92 and its center 88, such as at positions 86 and 90, the pivot pin is in position 96, approximately in the center of the bushing 48. Finally, when the die pin is approximately half way between its vertical extremes, at position 88, the pivot pin is at its longitudinally forwardmost position 98, furthest from the die housing bore 36.

The movement of the pivot pin 46 in bushing 48 is balanced, with the middle position 96 being approximately the center of the bushing. Rearward and forward extreme positions 94 and 98, respectively, are approximately equally spaced on each side of the center position. Thus, the bushing is utilized to receive the minimum available local compression over the full range of pivot pin movement. Use of the bushing enables the punch to have a simple structure, while having the ability to move the dies normally to each other for accuracy and durability of operation.

Various modifications of the punch structure are possible, all utilizing the concept that a carrying means will mount a first die on one of the handle levers for axial motion with respect to the other lever along a die axis that is non-radial to the pivot pin bore and lies substantially in a plane normal to the axis of the pivot pin bore. A connecting means will attach the second handle lever to the first die for inducing the die to move along the die axis in response to pivotal motion between the first and second levers. The resilient means carrying the pivot pin in its oversize bore will permit the pivot pin to radially deflect and allow straight motion of the connecting means, following the axis of the first die. Further, it is possible to have the pivot pin in a closely fitting bore and mount the die pin in an oversize bore with a resilient means, although the latter arrangement would be less desirable in terms of the specific operation of a punch, since the male die would be less accurately carried in its bore.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

The embodiments of the invention in which an exclusive property or privilege is claimed are defined as follows:

1. A hand tool having perpendicular acting dies and pivoted handle lever, comprising:

a first die housing defining therein a cavity for reception of a first die, the first die housing defining a transverse die pin bore across said cavity and further defining a transverse pivot pin bore offset longitudinally forwardly of the die pin bore and substantially parallel thereto;

a second die support member spaced from the first die housing;

a neck connecting the first die housing to the second die support member and defining a workpiece receiving space therebetween;

a first longitudinally extending handle lever having side walls depending over opposite transverse sides of the first die housing and defining longitudinally spaced apart apertures in alignment with each of the pivot pin bore and die pin bore;

a pivot pin received in the pivot pin bore and through the aligned apertures of said first handle lever, the diameter of the pivot pin being substantially smaller than the diameter of the pivot pin bore and leaving a substantial clearance between the pivot pin and the pivot pin bore wall;

a resilient means received in said pivot pin bore for occupying said clearance and permitting radial deflection of the pivot pin with respect to the pivot pin bore wall;

a first die having a stem supported in said cavity for axial sliding motion toward said second die support member and having a die pin connected to said stem and extending through said die pin bore and the aligned apertures of said first handle lever;

whereby pivotal motion of said first handle lever on the pivot pin causes axial displacement of the first die with radial displacement of the pivot pin against said resilient means within the pivot pin bore.

2. A hand tool with perpendicular acting dies on a pivoted handle, comprising:

a first handle lever;

a second handle lever;

a pivot pin bore defined through said first and second handle levers for common reception of a pivot pin;

a pivot pin received in said pivot pin bore, wherein the diameter of the pivot pin bore within at least one of the handle levers is substantially larger than the diameter of the pivot pin;

a resilient means supporting the pivot pin in said larger pivot pin bore for radial deflection;

a first die;

means carrying said first die for sliding motion with respect to the first handle lever along a die axis that is non-radial to the pivot pin bore and lies in a plane that is substantially normal to the axis of the pivot pin bore; and connecting means joining the second handle lever to the first die for inducing the die to move along the die axis in response to pivotal motion between the first and second handle levers, the resilient means permitting the pivot pin to radially deflect and permit straight motion of said connecting means.

3. A hand tool with perpendicular acting dies and pivoted handle, comprising:

a first die housing;

a second die support member;

a neck joining said first die housing and second die support member in mutually separated position and defining a workpiece-receiving cavity therebetween;

a first die carried by the first die housing for motion on an axis that is substantially perpendicular to the second die support member, wherein said first die housing defines a pivot pin bore of predetermined diameter and following an axis disposed in a plane substantially normal to said perpendicular axis of movement of the first die;

a pivot pin received in said pivot pin bore, said pivot pin having a substantially smaller diameter than the pivot pin bore;

a resilient means for radially supporting the pivot pin in the pivot pin bore and for allowing resiliently opposed radial motion of the pivot pin within the pivot pin bore; and a first handle lever pivotally attached to the first die housing at said pivot pin and moveably connected to said first die for moving the first die with respect to the first die housing in response to relative pivotal motion between the handle lever and first die housing.

4. The hand tool of claim 3, wherein said first die housing defines a die receiving bore located longitudinally rearwardly of said pivot pin bore, extending substantially perpendicularly to said second die support member and carrying said first die for axial motion therein, a lateral side of said die receiving bore defining a pair of elongated slots parallel to the axis of the die receiving bore, the hand tool further comprising:

a die pin extending through said elongated slots and engaging both said first die and said first handle lever for causing united axial movement therebetween.

5. The hand tool of claim 4, wherein said first handle lever comprises a head having a pair of spaced apart side walls overlapping the sides of said first die housing, the side walls defining a relatively forwardly located, transverse pivot pin bore engaging said pivot pin and permitting pivotal motion of the first handle lever with respect to the first die housing, the side walls further defining a relatively rearwardy located, transverse die pin bore engaging said die pin and moving the die pin with respect to the first die housing in response to pivotal motion of the first handle lever on the pivot pin.

6. The hand tool of claim 4, wherein said first die comprises:

a cylindrical stem sized to fit within said first die receiving bore for axial motion;

wherein the stem defines a diametric hole sized to receive said die pin and positioned to align with said elongated slots; and a die head attached to an axial end of said stem.

7. The hand tool of claim 6 wherein said die head comprises a multiple die attached to said stem.

8. The hand tool of claim 3, further comprising:

a spring carried between said first handle lever and first die housing and spring-biasing the first handle lever toward a predetermined pivotal position about said pivot pin with respect to the first die housing.

9. The hand tool of claim 8, wherein said spring is a compression spring and said first handle lever is spring-biased thereby toward a position holding said first die away from said second die support member.

* * * * *